US009176458B2

(12) United States Patent
Imanaka

(10) Patent No.: US 9,176,458 B2
(45) Date of Patent: Nov. 3, 2015

(54) IMAGE FORMING APPARATUS

(71) Applicant: KYOCERA Document Solutions Inc., Osaka (JP)

(72) Inventor: Koichi Imanaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/568,578

(22) Filed: Dec. 12, 2014

(65) Prior Publication Data

US 2015/0185682 A1 Jul. 2, 2015

(30) Foreign Application Priority Data

Dec. 26, 2013 (JP) ..... 2013-268885

(51) Int. Cl.
*G03G 21/00* (2006.01)
*G03G 21/10* (2006.01)

(52) U.S. Cl.
CPC ..... *G03G 21/105* (2013.01)

(58) Field of Classification Search
CPC ..... G03G 21/10; G03G 21/105
USPC ..... 399/358–360
See application file for complete search history.

(56) References Cited

U.S. PATENT DOCUMENTS

2005/0169649 A1* 8/2005 Onodera et al. ..... 399/35
2009/0257798 A1* 10/2009 Hoshino ..... 399/358

FOREIGN PATENT DOCUMENTS

JP 2006-171105 6/2006

* cited by examiner

*Primary Examiner* — David Bolduc
*Assistant Examiner* — Barnabas Fekete
(74) *Attorney, Agent, or Firm* — Wenderoth, Lind & Ponack, L.L.P.

(57) ABSTRACT

An image forming apparatus includes an image forming unit, a waste toner accommodating unit, a movement member, and a driving mechanism. The image forming unit forms an image by using a toner. The waste toner accommodating unit accommodates a waste toner after being used in the image forming unit. The movement member is supported so as to move in a direction parallel with a falling direction of the waste toner in a toner falling path, through which the waste toner falls, of a movement path of the waste toner that moves from the image forming unit to the waste toner accommodating unit. The driving mechanism reciprocates the movement member in the direction parallel with the falling direction of the waste toner.

5 Claims, 9 Drawing Sheets

IMAGE FORMING APPARATUS

CROSS-REFERENCE TO RELATED APPLICATION

This application is based upon and claims the benefit of priority from Japanese Patent Application No. 2013-268885 filed on Dec. 26, 2013, the entire contents of which are incorporated herein by reference.

BACKGROUND

The technology of the present disclosure relates to an electrophotographic image forming apparatus which performs image forming by using a toner.

In general, in an electrophotographic image forming apparatus such as a copy machine, a printer, and a facsimile, an electrostatic latent image formed on an image carrying member such as a photosensitive drum is visualized by a developer (a toner) in a developing device, and the toner image is transferred to a recording medium. At this time, since a toner not transferred to the recording medium remains on the surface of the photosensitive drum, the remaining toner is removed from the surface of the photosensitive drum by a cleaning device. The remaining toner removed from the surface of the photosensitive drum is horizontally conveyed to an end portion in a horizontal direction by a screw as a waste toner, is fallen from the end portion, and is put into and stored in a disposal bottle.

The waste toner that is removed from the surface of the photosensitive drum has a low fluidity due to mechanical stress or mixing of impurities such as paper powder, and is easily solidified. Therefore, there is a case in which the waste toner is solidified and clogged on a conveying path of the waste toner.

Conventionally, there has been known a technology for allowing a leaf spring to intermittently make contact with a toner stirring and conveying blade of a rotating conveying auger of a developing device so as to vibrate the blade, and loosening a toner piled on a falling conveying path, through which a toner is supplied to a developing unit, by using the vibration.

SUMMARY

An image forming apparatus according to one aspect of the present disclosure includes an image forming unit, a waste toner accommodating unit, a movement member, and a driving mechanism. The image forming unit forms an image by using a toner. The waste toner accommodating unit accommodates a waste toner after being used in the image forming unit. The movement member is supported movably in a direction parallel with a falling direction of the waste toner in a toner falling path, through which the waste toner falls, of a movement path of the waste toner that moves from the image forming unit to the waste toner accommodating unit. The driving mechanism reciprocates the movement member in the direction parallel with the falling direction of the waste toner.

DETAILED DESCRIPTION

Hereinafter, the present embodiment will now be described in detail with reference to the accompanying drawings. In addition, an embodiment described below is only an example, and does not limit the technical scope of the present disclosure.

Figure 1:
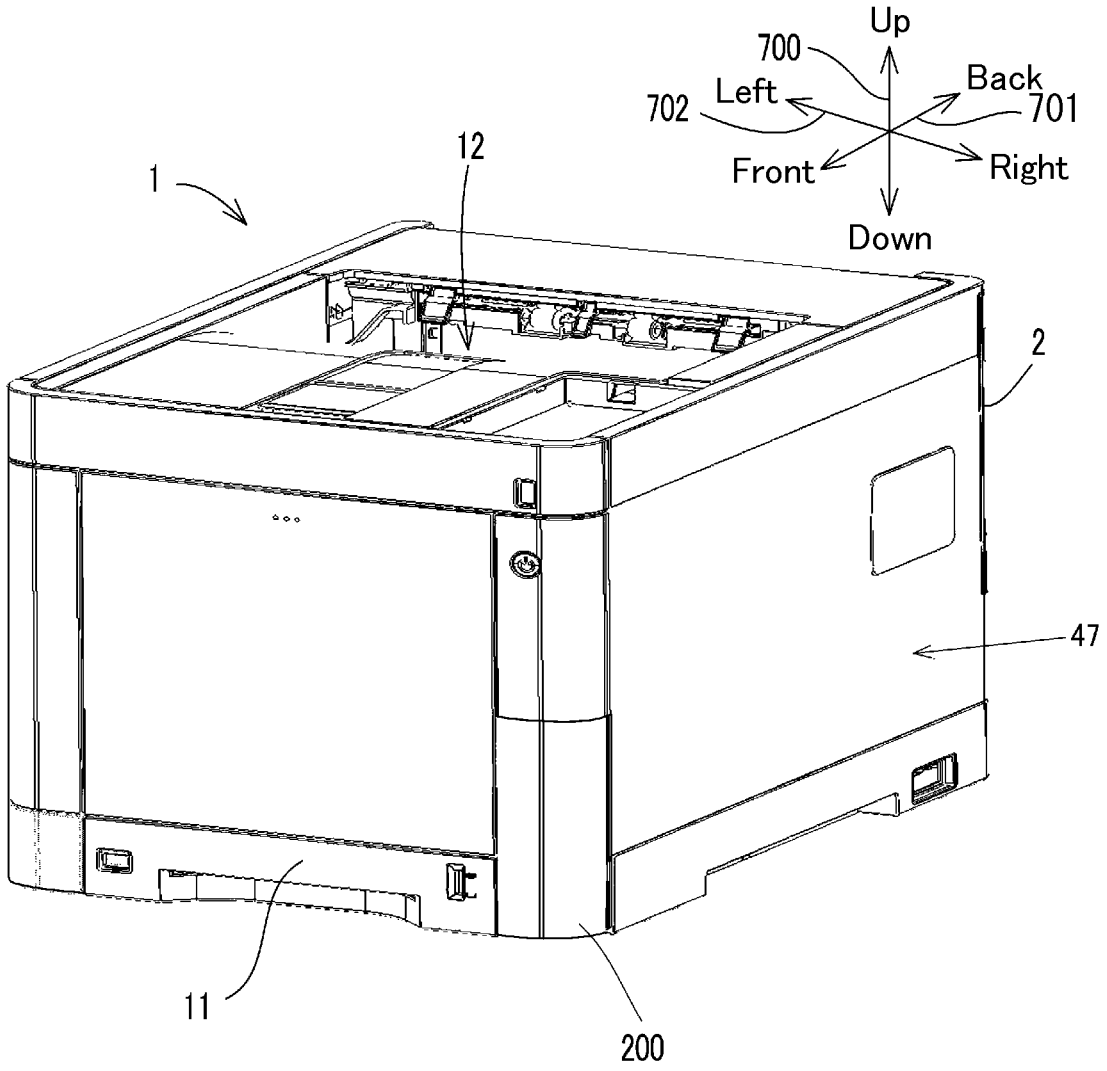
FIG. 1 is a schematic configuration diagram showing the configuration of an image forming apparatus according to the present embodiment.

FIG. 1 is a schematic configuration diagram showing the configuration of an image forming apparatus 1 according to the present embodiment. The image forming apparatus 1 is an example of an image forming apparatus. In the following description, on the basis of the state (the state of FIG. 1) in which the image forming apparatus 1 has been installed to be usable, the image forming apparatus 1 will be described using an up-down direction 700, a front-back direction 701, and a left-right direction 702 defined in FIG. 1.

As shown in FIG. 1, the image forming apparatus 1 is a multifunctional peripheral having functions including a scanner function, a copy function, a printer function, a facsimile function and the like. The image forming apparatus 1 prints an inputted image on a printing sheet by using a printing material such as a toner. In addition, the image forming apparatus 1 is not limited to a multifunctional peripheral, and a printer, a facsimile, a copy machine and the like are also an example of an image forming apparatus.

The image forming apparatus 1 prints an image on a printing sheet based on image data inputted from an exterior through a network communication unit (not shown). As shown in FIG. 1, the image forming apparatus 1 has a housing 2 including an outer frame cover and an internal frame.

Figure 2:
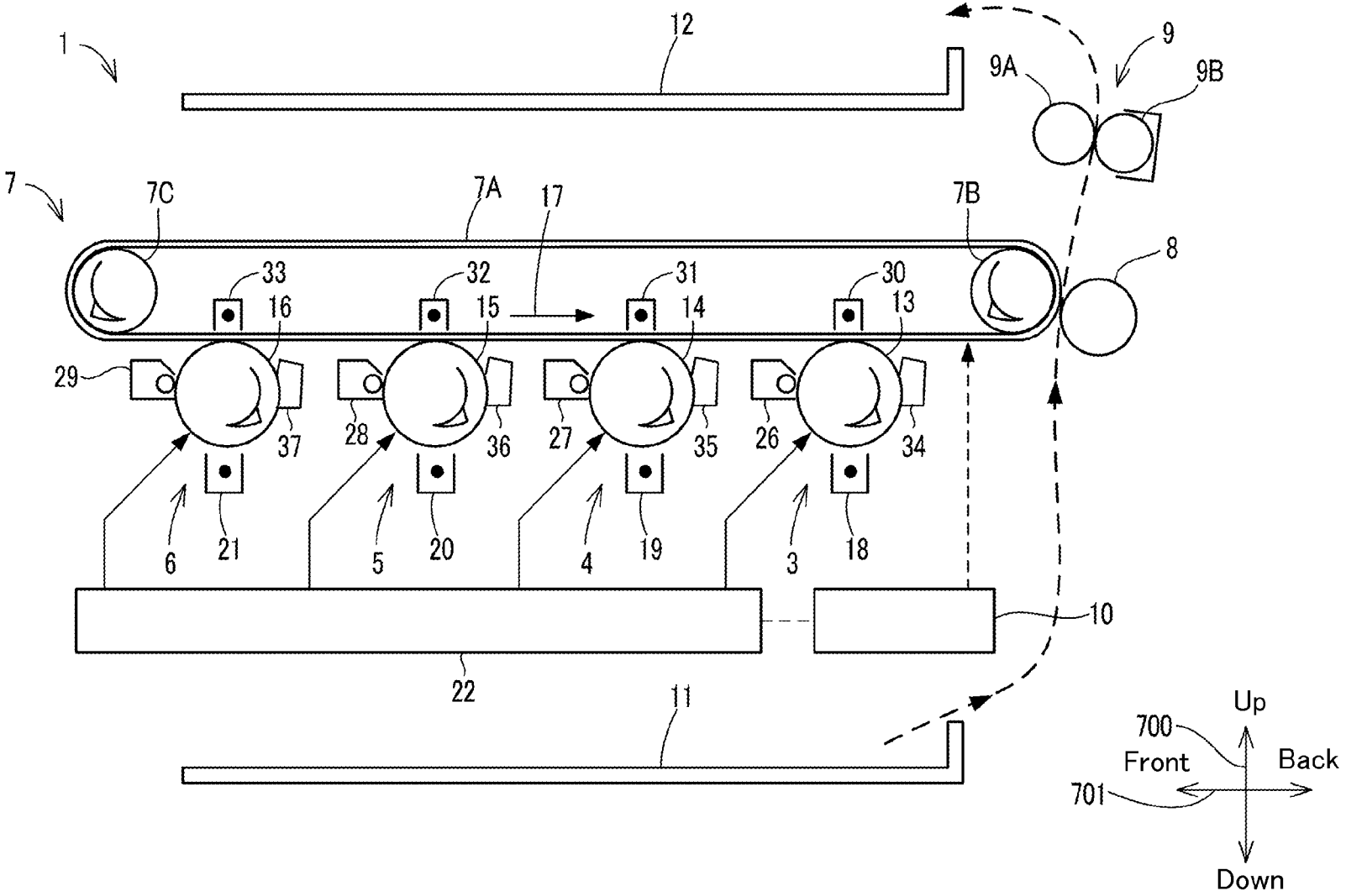
FIG. 2 is a schematic diagram showing the internal configuration of an embodiment of an image forming apparatus according to the present embodiment.

As shown in FIG. 2, the image forming apparatus 1 is a so-called tandem type color image forming apparatus, and includes image forming units 3 to 6, an intermediate transfer unit 7, a secondary transfer device 8, a fixing device 9, a control unit 10, a sheet-feeding unit 11, and a sheet discharge unit 12.

The image forming units 3 to 6 are provided in parallel with one another in the front-back direction 701. The image forming units 3 to 6 form toner images having colors different from one another. The image forming unit 3 is an image forming unit for black, the image forming unit 4 is an image forming unit for yellow, the image forming unit 5 is an image forming unit for cyan, and the image forming unit 6 is an image forming unit for magenta.

The image forming units 3 to 6 are provided with photosensitive drums 13 to 16 that carry toner images, charging devices 18 to 21 that serve to charge the surfaces of the photosensitive drums 13 to 16, and an exposure device 22 that exposures the charged surfaces of the photosensitive drums 13 to 16, scans light, and writes electrostatic latent images, respectively. Furthermore, the image forming units 3 to 6 are provided with developing devices 26 to 29 that develop the electrostatic latent images on the photosensitive drums 13 to 16 by toners, primary transfer devices 30 to 33 that transfer toner images of the rotating photosensitive drums 13 to 16 to an intermediate transfer belt 7A that is moving, and cleaning units 34 to 37 that remove remaining toners on the photosensitive drums 13 to 16, respectively.

The intermediate transfer unit 7 has the intermediate transfer belt 7A, a driving roller 7B, and a driven roller 7C. The intermediate transfer unit 7 is an endless annular belt made of material such as rubber or urethane. The intermediate transfer belt 7A is supported by the driving roller 7B and the driven roller 7C so as to be rotationally driven. The driving roller 7B is disposed at a position (the right side in FIG. 2) near the fixing device 9, and the driven roller 7C is disposed at a position (the left side in FIG. 2) away from the fixing device 9. The surface of the driving roller 7B, for example, is made of a material such as rubber and urethane in order to increase frictional force with the intermediate transfer belt 7A.

In an example shown in FIG. 2, the image forming unit 3 for black, the image forming unit 4 for yellow, the image forming unit 5 for cyan, and the image forming unit 6 for magenta are disposed in a row sequentially from the rear side in the front-back direction 701. The intermediate transfer belt 7A is supported by the driving roller 7B and the driven roller 7C, so that the surface of the intermediate transfer belt 7A can move (travel) while being in contact with the surfaces of the photosensitive drums 13 to 16. When the surface of the intermediate transfer belt 7A passes through between the photosensitive drums 13 to 16 and the primary transfer devices 30 to 33, toner images are sequentially transferred from the photosensitive drums 13 to 16 to be superposed onto the intermediate transfer belt 7A.

The secondary transfer device 8 transfers the toner image, which has been transferred to the intermediate transfer belt 7A, to a printing sheet conveyed from the sheet-feeding unit 11. The printing sheet, to which the toner image has been transferred, is conveyed to the fixing device 9 by a conveying means (not shown). The fixing device 9 has a heating roller 9A heated at a temperature of about 200° C. or more and a pressing roller 9B disposed to face the heating roller 9A. The printing sheet conveyed to the fixing device 9 is conveyed while being interposed between the heating roller 9A and the pressing roller 9B, so that the toner image is welded to the printing sheet. Then, the printing sheet is discharged to the sheet discharge unit 12.

As described above, in the image forming apparatus 1, a toner image of each color is transferred to and superposed onto the traveling intermediate transfer belt 7A by the plurality of image forming units 3 to 6, so that a color toner image is formed on the surface of the intermediate transfer belt 7A. Moreover, in the image forming apparatus 1, the color toner image is transferred from the intermediate transfer belt 7A to the printing sheet by the secondary transfer device 8, so that a color image is formed on the printing sheet. It is noted that a configuration, in which the intermediate transfer belt 7A is used as a conveying belt and a toner image is directly transferred to be superposed onto a printing sheet conveyed on the conveying belt, is also considered as another embodiment. Furthermore, a configuration, in which a roller-shaped intermediate transfer member is used instead of the intermediate transfer belt 7A, is also considered as another embodiment.

The cleaning units 34 to 37 remove toners (waste toners) remaining on the surfaces of the photosensitive drums 13 to 16 after the toner image is transferred to the sheet. The cleaning units 34 to 37 will be described later.

The sheet-feeding unit 11 has a sheet-feeding cassette that accommodates sheets on which images are to be formed by the image forming units 3 to 6 and the like. The sheet-feeding cassette can accommodate a plurality of sheets in a stacked state.

Figure 3:
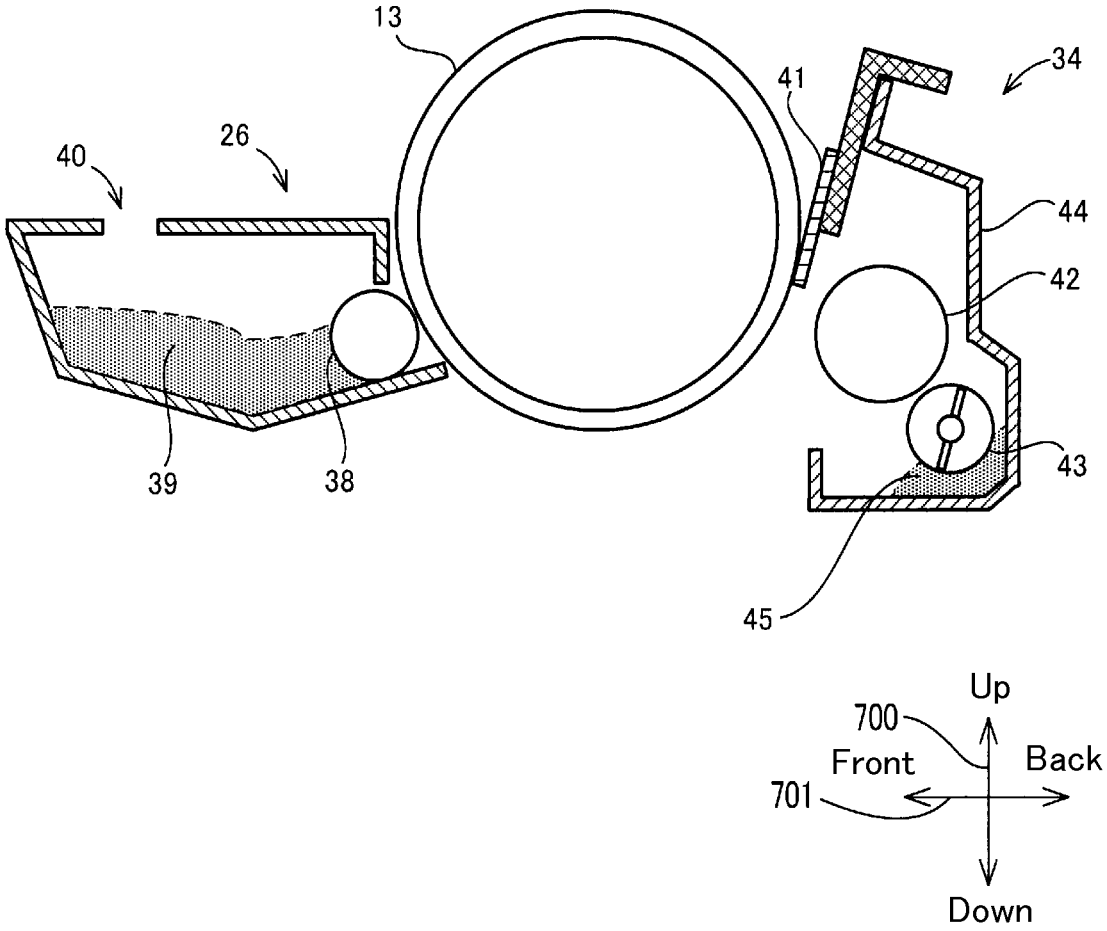
FIG. 3 is a diagram showing the configuration of an image forming unit.

FIG. 3 is a sectional view schematically showing the photosensitive drums 13 to 16, the developing devices 26 to 29, and the cleaning units 34 to 37 in the image forming units 3 to 6. Since the image forming units 3 to 6 have the same configuration, they will be described while focusing on the image forming unit 3.

As shown in FIG. 3, the image forming unit 3 is provided with the developing device 26, the photosensitive drum 13, and the cleaning unit 34.

The developing device 26 is provided with a magnet roller 38 for development in the vicinity of the photosensitive drum 13. A bias with the same polarity as the charged polarity of the photosensitive drum 13 is applied to the magnet roller 38. By the magnet roller 38, a toner 39 serving as a developer is charged and is flown to the electrostatic latent image of the surface of the photosensitive drum 13, so that the electrostatic latent image is developed. The toner 39 is supplied from a toner container (not shown) via a toner supply port 40.

The cleaning unit 34 is provided with a cleaning blade 41 serving as a cleaning member, a cleaning roller 42, a discharge screw 43, and a toner box 44. The cleaning roller 42 and the cleaning blade 41 are provided to have approximately the same axial length as that of the photosensitive drum 13, and to be in contact with the photosensitive drum 13.

After the toner image is transferred to the printing sheet, the cleaning roller 42 and the cleaning blade 41 of the cleaning unit 34 remove and clean a waste toner remaining on the surface of the photosensitive drum 13. The waste toner removed from the surface of the photosensitive drum 13 is taken into the toner box 44 according to the action of gravity or the rotation of the cleaning roller 42. The waste toner 45 taken into the toner box 44 is conveyed from the back side of the paper of FIG. 2 to the front side (from the left side to the right side in the left-right direction 702 of the image forming apparatus 1) by the discharge screw 43.

Figure 4:
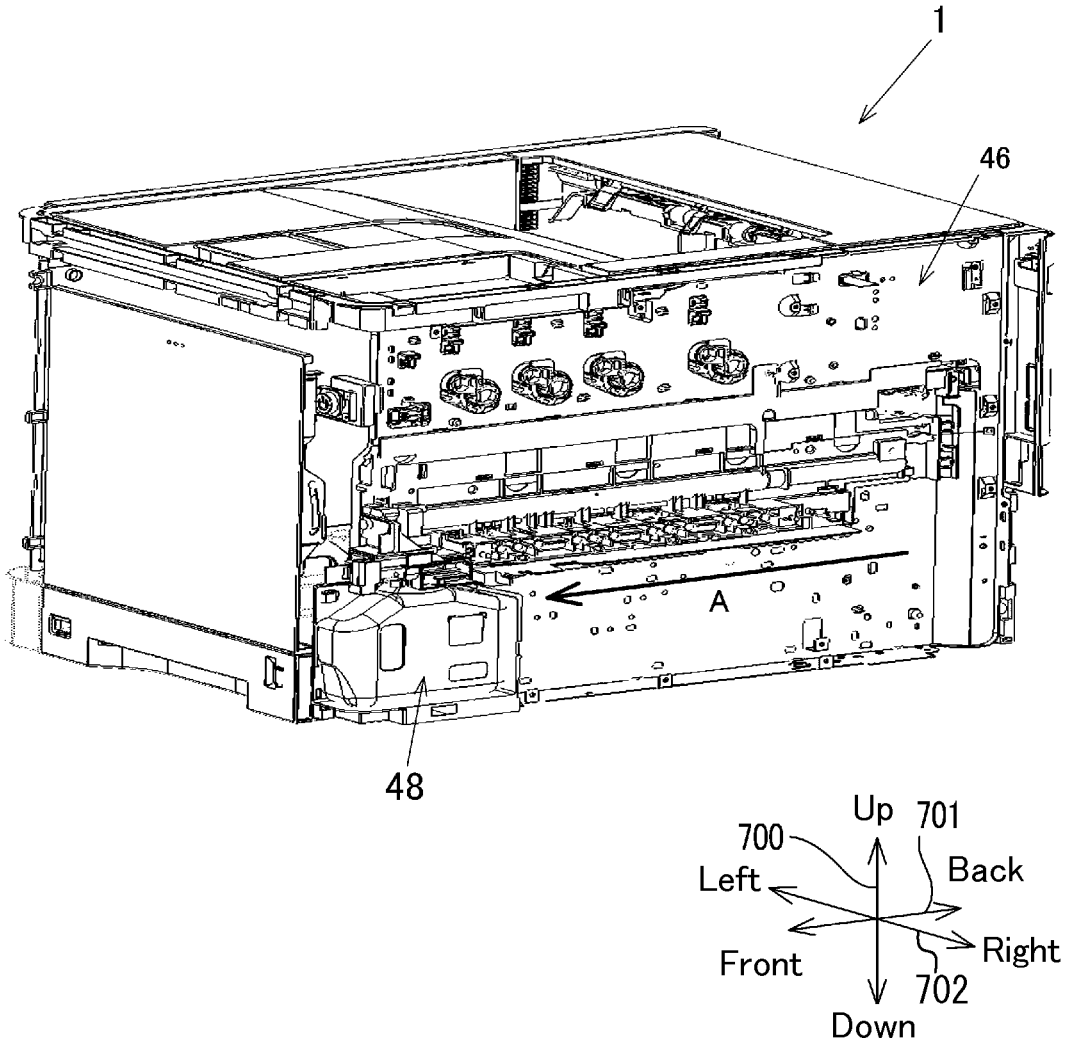
FIG. 4 is an external appearance perspective view showing the internal configuration of an image forming apparatus after a right side cover and a waste toner conveying unit of a housing are detached.
Figure 5:
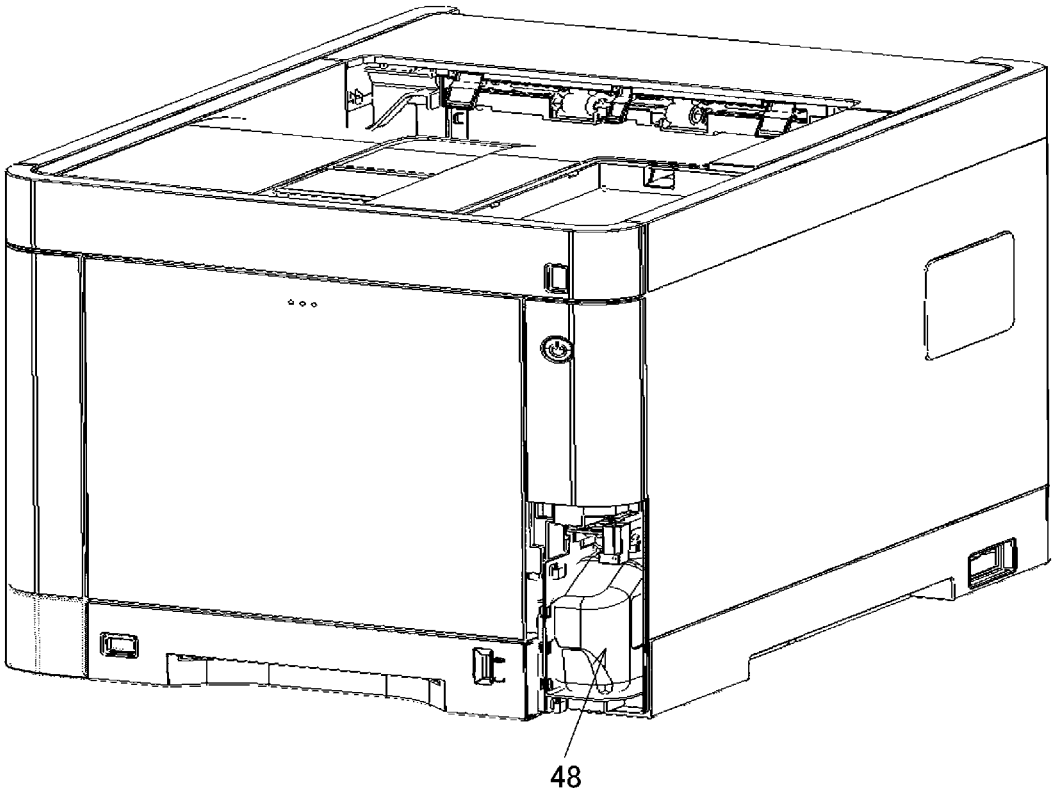
FIG. 5 is a diagram explaining an installation position of a disposal bottle in an image forming apparatus.

As shown in FIG. 1, the right side of the housing 2 of the image forming apparatus 1 is provided with a detachable outer cover 47, and when the outer cover 47 is detached, a waste toner conveying unit 46 and a disposal bottle 48 are exposed as shown in FIG. 4. It is noted that as shown in FIG. 5, a lower half of the right side corner of the front surface of the housing 2 is provided with a detachable outer cover 200. When the outer cover 200 is detached, only the disposal bottle 48 is exposed, so that the disposal bottle 48 can be detached from the apparatus body.

Figure 6:
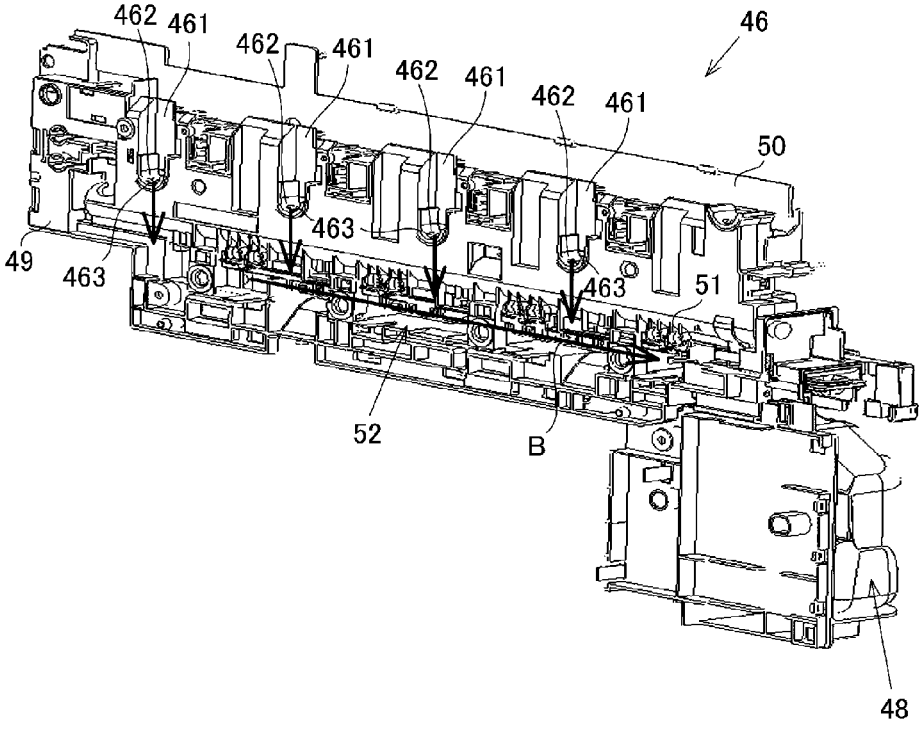
FIG. 6 is an external appearance perspective view of a waste toner conveying unit detached from a housing.
Figure 7:
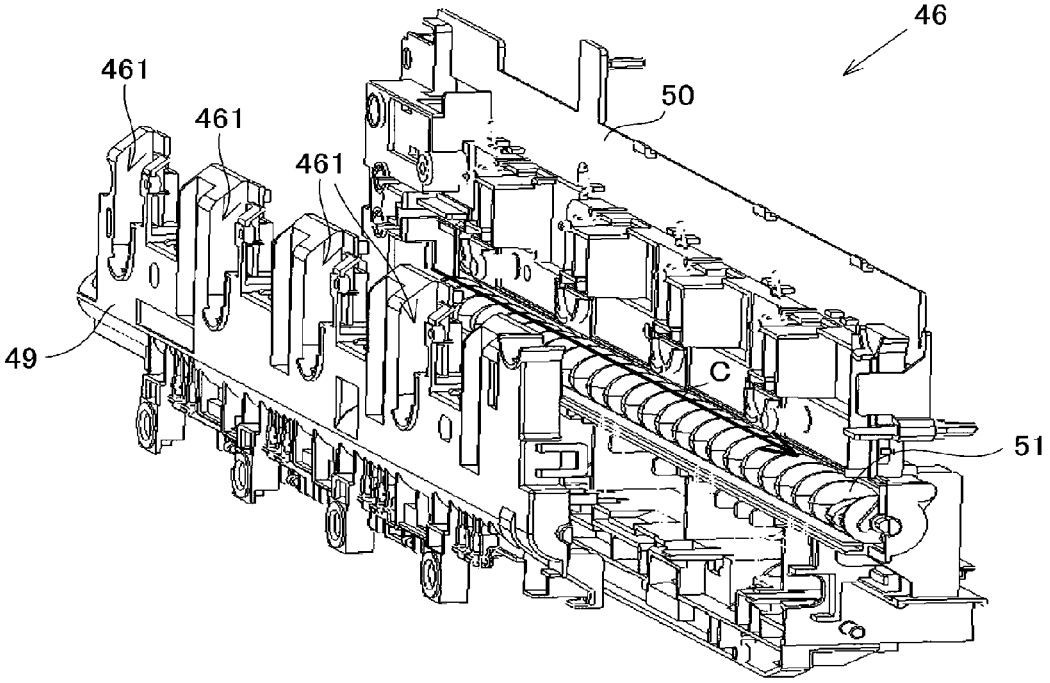
FIG. 7 is an exploded perspective view of a waste toner conveying unit.

The waste toner conveying unit 46 exposed by detaching the outer cover 47 is detachable from the apparatus body at the right side of the image forming apparatus 1. As shown in FIG. 6, the waste toner conveying unit 46 extends in the front-back direction 701 so as to be connectable to the four cleaning units 34 installed in parallel with one another. As shown in FIG. 6 and FIG. 7, the waste toner conveying unit 46 has a first casing member 49, a second casing member 50, and a conveying screw 51. The first casing member 49 and the second casing member 50 constitute the casing of the waste toner conveying unit 46. By the first casing member 49 and the second casing member 50, a waste toner conveying room 52 (referring to FIG. 6) extending in the front-back direction at the right side of the image forming apparatus 1 is formed. The conveying screw 51 is stored in the waste toner conveying room 52.

The first casing member 49 is formed with four unit connection grooves 461 at a regular interval, to which outlets (not shown) for toner discharge provided to each cleaning unit 34 are connected. Each unit connection groove 461 has a shape cut from the upper side to the lower side, and an end portion having the outlet of the cleaning unit 34 is inserted downward from an upper end. Each unit connection groove 461 is provided a lower end thereof with a contact portion 462 having a shape corresponding to the shape of the end portion of the cleaning unit 34. The contact portion 462 is formed at a lower circumferential surface thereof with a waste toner introduction port 463.

When each cleaning unit 34 is connected to the waste toner conveying unit 46, the outlet (not shown) formed in each cleaning unit 34 and the waste toner introduction port 463 of the contact portion 462 communicate with each other. The waste toner conveying room 52 is provided below each waste toner introduction port 463 and is connected to each waste toner introduction port 463 via a falling path (not shown). Consequently, waste toners conveyed from the cleaning units 34 join in the waste toner conveying room 52 via each waste toner introduction port 463.

As described above, waste toners conveyed from the image forming units 3 to 6 are conveyed to the waste toner conveying room 52. The conveying screw 51 horizontally conveys the conveyed waste toners to the disposal bottle 48, which is provided at the right side corner of the front surface from the back side of the image forming apparatus 1, in directions indicated by arrows A, B, and C of FIG. 4, FIG. 6, and FIG. 7. The disposal bottle 48 is an example of a waste toner accommodating unit, and accommodates waste toners after being used in the image forming units 3 to 6.

Figure 8A:
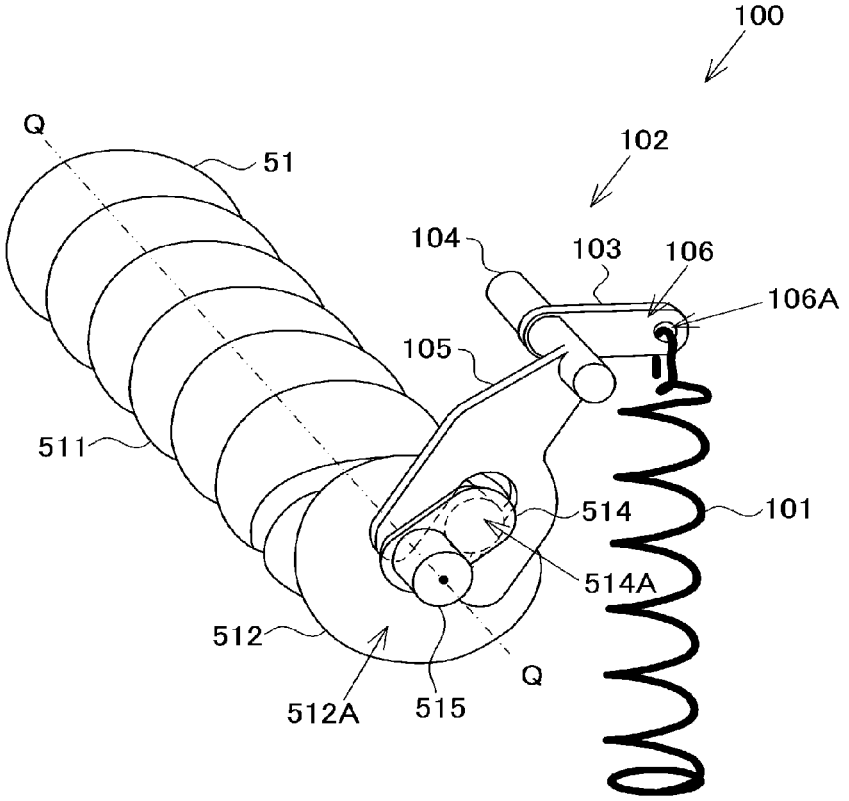
FIG. 8A is a diagram explaining a power transmission mechanism.
Figure 8B:
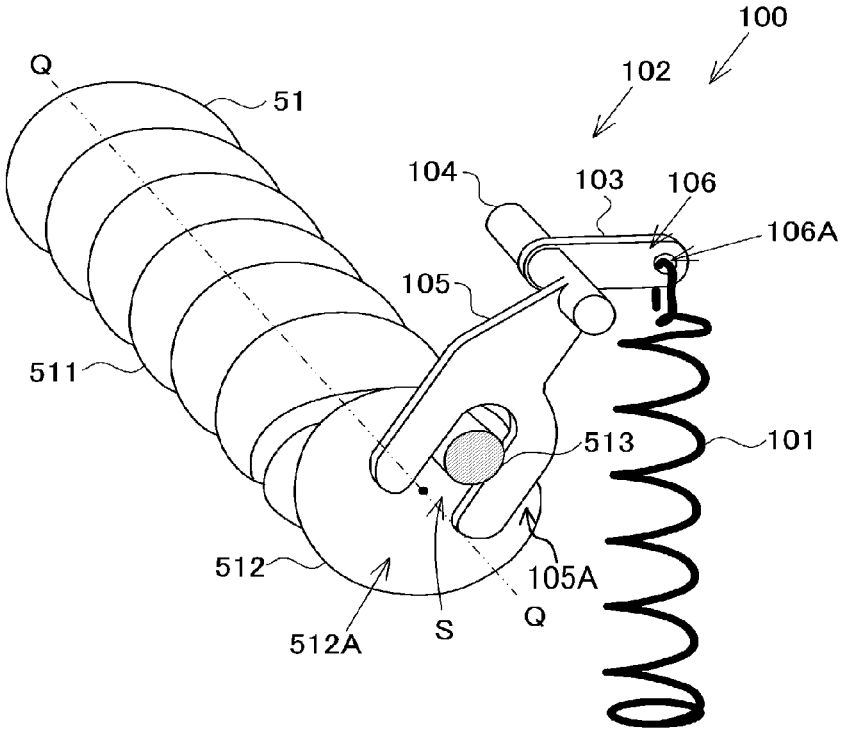
FIG. 8B is a diagram in which a rotating shaft portion and a restraint plate portion are excluded from a power transmission mechanism of FIG. 8A.

As shown in FIG. 8A and FIG. 8B, the conveying screw 51 has a conveying blade 511. Furthermore, the conveying screw 51 has a disc portion 512, an engaging portion 513, a restraint plate portion 514, and a rotating shaft portion 515 at an end portion of a downstream side in the conveying direction of the waste toner.

The conveying blade 511 is formed in a spiral shape around a rotary shaft core Q of the conveying screw 51. The disc portion 512 is provided at one end portion of the conveying blade 511 and has a disc shape with a predetermined diameter. The disc portion 512 is provided such that the normal of the disc portion 512 is parallel with the rotary shaft core Q and the rotary shaft core Q passes through the center of the disc portion 512.

As shown in FIG. 8B, the engaging portion 513 is provided to an outer side surface 512A opposite to the conveying screw 51 of both surfaces of the disc portion 512. Furthermore, the engaging portion 513 extends in a cylindrical shape from the outer side surface 512A of the disc portion 512 by a predetermined length in parallel with the rotary shaft core Q at a position eccentric from the central position of the disc portion 512.

The restraint plate portion 514 is provided at an end portion opposite to the disc portion 512 of both ends of the engaging portion 513 in the direction of the rotary shaft core Q, and has a slightly long shape in one direction. Furthermore, the restraint plate portion 514 has a surface spreading wider than the diameter of the engaging portion 513. One end portion side of the restraint plate portion 514 and the engaging portion 513 are connected to each other. The restraint plate portion 514 prevents the engaging portion 513 and a first arm portion 105 of a swing member 103, which will be described later, from being disengaged.

The rotating shaft portion 515 has a cylindrical shape. The rotating shaft portion 515 is provided at an outer surface 514A opposite to the engaging portion 513 of both surfaces of the restraint plate portion 514 such that the sectional center of the rotating shaft portion 515 coincides with the position of the rotary shaft core Q. The rotating shaft portion 515 is supported to the casing, which includes the first casing member 49 and the second casing member 50, so as to rotate. The same rotating shaft portion 515 is provided to an opposite end portion of the conveying screw 51, and is also supported to the casing so as to rotate. The rotating shaft portion 515 is connected to a rotary shaft (not shown) of a driving motor and is rotationally driven by the driving motor. When the rotating driving force of the driving motor is transmitted to the rotating shaft portion 515, the engaging portion 513, the conveying blade 511, the disc portion 512, and the restraint plate portion 514 rotate. At this time, when seen from one side to the other side of the rotary shaft core Q, the engaging portion 513 revolves around the position of the rotary shaft core Q on a plane orthogonal to the rotary shaft core Q.

Figure 9:
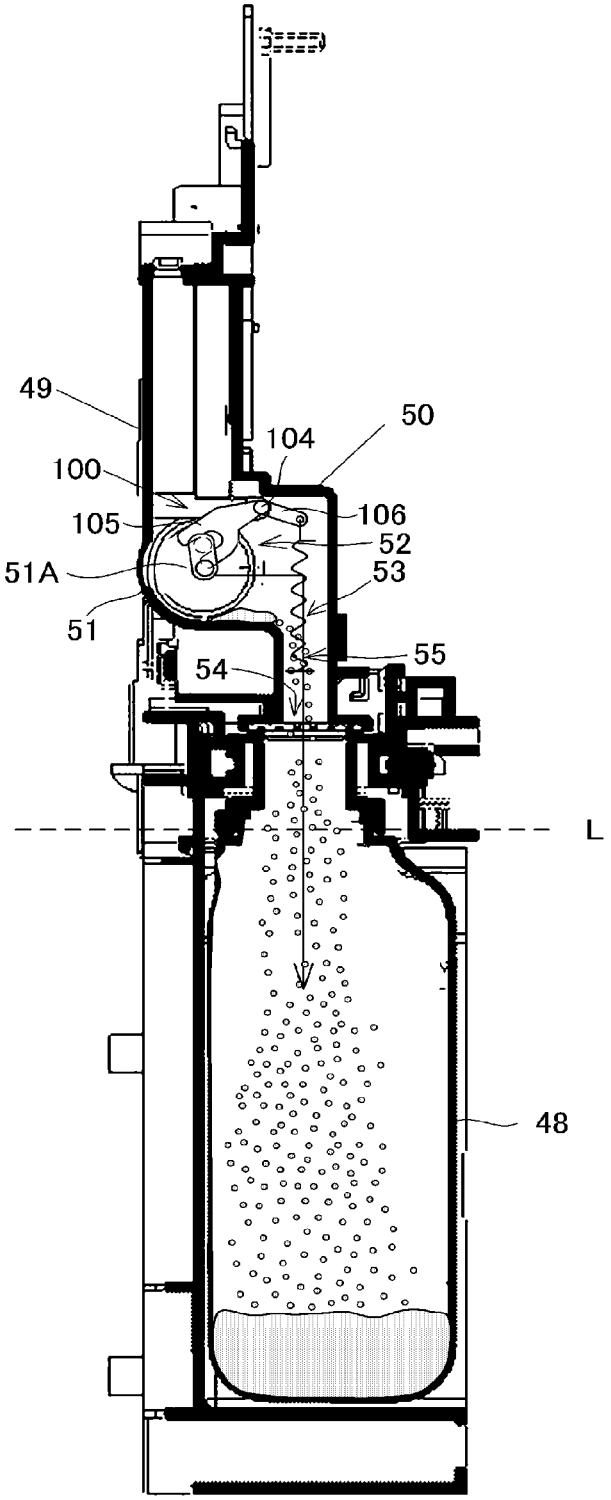
FIG. 9 is a diagram explaining a positional relation and the like between a waste toner conveying unit and a disposal bottle, when seen from a conveying direction by a conveying screw of a waste toner conveying unit.

As shown in FIG. 9, a waste toner falling port 53 for discharging waster toners downward is formed at an end portion of a waster toner downstream side of the waste toner conveying room 52. In the present embodiment, the waste toner falling port 53 is provided at a position separated from the rotary shaft core Q of the conveying screw 51 in a direction, which is parallel with the horizontal direction (the conveying direction of the waste toners by the conveying screw 51) and is orthogonal to the rotary shaft core Q of the conveying screw 51, that is, the left-right direction of FIG. 9. A toner inlet 54 provided at an upper portion of the disposal bottle 48 is positioned below the waste toner falling port 53.

When the waste toners of the waste toner conveying room 52 are conveyed by the conveying screw 51 in the horizontal direction and are piled at one end portion of the downstream side of the waste toner conveying room 52 to a certain degree, a part of the waste toners moves toward the waste toner falling port 53. When the waste toners reach the waste toner falling port 53, the waste toners fall downward from the waste toner falling port 53 and are stored in the waster toner accommodating space of the disposal bottle 48.

As described above, a toner movement path 55 from the waste toner falling port 53 to the toner inlet 54 of the disposal bottle 48 serves as a toner falling path through which the waste toners fall. The waste toners have a low fluidity due to mechanical stress or mixing of impurities such as paper powder, and are easily solidified. Therefore, it is considered that the waste toners having a low fluidity are solidified and clogged in the toner falling path 55.

In the present embodiment, a toner loosening mechanism 100 for loosening toners piled in the toner falling path 55 is provided. The toner loosening mechanism 100 has a coil spring 101 and a driving mechanism 102 as shown in FIG. 8A, FIG. 8B, and FIG. 9.

The coil spring 101 is an example of a movement member and is a member for loosening the waster toners piled in the toner falling path 55. The coil spring 101 is disposed with the axial direction of the coil spring 101 laid along a direction in which the toner falling path 55 extends. The coil spring 101 is employed as a movement member, so that it is possible to configure the movement member at a low cost.

The driving mechanism 102 reciprocates the coil spring 101 in a direction parallel with the toner falling path 55. In the present embodiment, the driving mechanism 102 converts the rotative power of the conveying screw 51 into power in a vertical up-down direction parallel with the falling direction of the waste toners, and transmits the power to the coil spring 101. The driving mechanism 102 has the aforementioned engaging portion 513 and swing member 103.

As shown in FIG. 8A and FIG. 8B, the swing member 103 has a swing center shaft 104, the first arm portion 105, and a second arm portion 106. The swing center shaft 104 is parallel with the rotary shaft core Q of the conveying screw 51. The swing member 103 is supported to a predetermined position of the second casing member 50 (referring to FIG. 7) by the swing center shaft 104 so as to rotate.

The first arm portion 105 extends radially outward from the swing center shaft 104 in a direction orthogonal to the swing center shaft 104. The tip portion of the first arm portion 105 has a bifurcated shape, and the aforementioned engaging portion 513 is fitted into a space S of the bifurcated portion 105A. That is, the first arm portion 105 engages with the engaging portion 513. The length of the space S is set to a length for preventing the engaging portion 513 from escaping from the bifurcated portion 105A even if the engaging portion 513 is displaced together with the rotation of the conveying screw 51. Consequently, when the conveying screw 51 rotates, the engaging portion 513 relatively moves in the bifurcated portion 105A.

The second arm portion 106 is a stick-shaped portion that extends from the swing center shaft 104 in a direction orthogonal to the swing center shaft 104 and different from the direction in which the first arm portion 105 extends. The second arm portion 106 is formed at a tip portion thereof with an engaging hole 106A, and one end of the coil spring 101 is engaged with the engaging hole 106A. The other end of the coil spring 101 is formed to be a free end.

Figure 10:
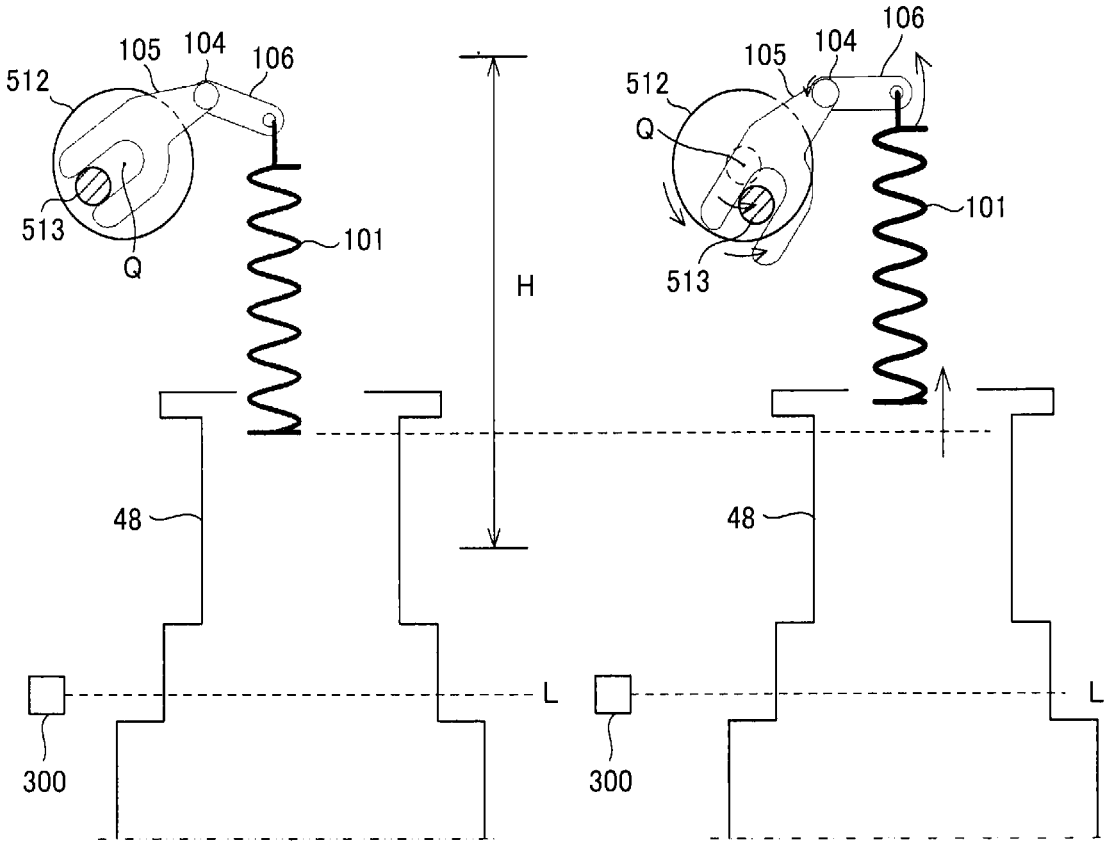
FIG. 10 is a diagram explaining the operation of a toner loosening mechanism.

As shown in FIG. 10, when the conveying screw 51 rotates, the engaging portion 513 revolves around the position of the rotary shaft core Q on a plane orthogonal to the rotary shaft core Q, together with the rotation of the conveying screw 51. At this time, the first arm portion 105 receives force in a direction parallel with the plane from the engaging portion 513. In this way, the first arm portion 105 swings around the swing center shaft 104. Consequently, by the swing, the tip portion of the second arm portion 106 displaces up and down. In this way, the coil spring 101 engaged with the tip portion of the second arm portion 106 moves up and down. As described above, the coil spring 101 moves in a direction, which is parallel with the falling direction of the waste toners, in the toner falling path 55, through which the waste toners fall, of the movement path of the waste toners which move from the image forming units 3 to 6 to the disposal bottle 48.

When the waster toners are piled in a movable range H (referring to FIG. 10) of the coil spring 101, the piled waster toners are loosened by the coil spring 101 moving up and down. In this way, it is possible to prevent the waster toners from being clogged in the toner falling path 55 from the waste toner falling port 53 to the toner inlet 54 of the disposal bottle 48.

Furthermore, the present embodiment employs the configuration in which the swing member 103 having the swing center shaft 104, and the first and second arm portions 105 106 extending in the different direction from the swing center shaft 104 is allowed to swing on the plane orthogonal to the swing center shaft 104. In this way, the rotative power of the conveying screw 51 can be converted into power in a vertical up-down direction component at a position separated from the rotary shaft core Q in the direction orthogonal to the rotary shaft core Q of the conveying screw 51, and can be transmitted. In this way, even when the toner falling path 55 is separated from the rotary shaft core Q in the direction orthogonal to the rotary shaft core Q, it is possible to loosen the waste toners piled on the toner falling path 55.

As shown in FIG. 10, the image forming apparatus 1 is provide with a full detection sensor 300 as a full detection unit that detects the full state of the waste toners in the disposal bottle 48. The full detection sensor 300 is a reflective optical sensor having, for example, a light emitter including a light emitting diode, and for example, a light receiver including a phototransistor. When the waste toners exist in a detection position L (referring to FIG. 9 and FIG. 10), light emitted from the light emitter is reflected by the waste toners, and the reflected light is received by the light receiver.

The movable range H of the coil spring 101 according to the rotation of the conveying screw 51 is set at a position above the detection position L by the full detection sensor 300. In this way, it is possible to avoid that the coil spring 101 is erroneously detected as a waste toner when the coil spring 101 enters the detection position L of the full detection sensor 300.

So far, a preferred embodiment has been described; however, the present invention is not limited to the aforementioned contents, and various modifications can be applied.

For example, in the above embodiment, the coil spring 101 is employed as an example of a movement member; however, the movement member is not limited thereto. For example, a rod-shaped member having a uniform shape in the longitudinal direction may also be employed, or a plurality of needle-shaped or strip-shaped portions may also be formed at the tip portion thereof.

What is claimed is:

1. An image forming apparatus comprising:

an image forming unit that forms an image by using a toner;

a waste toner accommodating unit that accommodates a waste toner after being used in the image forming unit;

a screw having a blade and conveying the waste toner, which is discharged from the image forming unit, in a horizontal direction;

a waste toner conveying room accommodating the screw;

a movement member supported movably in a direction parallel with a falling direction of the waste toner in a toner falling path, which is connected to the waste toner conveying room, and through which the waste toner falls, of a movement path of the waste toner that moves from the image forming unit to the waste toner accommodating unit; and a driving mechanism that reciprocates the movement member in the direction parallel with the falling direction of the waste toner, wherein the driving mechanism includes:

an engaging portion that is provided at a position offset from a rotation center of the screw and displaces together with rotation of the screw;

a first arm portion that engages with the engaging portion, and receives force from the displacing engaging portion to be swingable around a predetermined swing shaft parallel with the rotation center of the screw; and a second arm portion that is swingable around the swing shaft together with the first arm portion, and supports the movement member, and the driving mechanism is configured to convert rotative power of the screw, which is rotationally driven, into power in the direction parallel with the falling direction of the waste toner, and transmit the power to the movement member.

2. The image forming apparatus of claim 1, wherein the toner falling path is a path parallel with a vertical direction, and the driving mechanism reciprocates the movement member in a vertical up-down direction.

3. The image forming apparatus of claim 1, wherein the image forming apparatus comprises:

a plurality of the image forming units disposed in a row, wherein the screw conveys the waste toner, which is discharged from each of the image forming units, in the horizontal direction, and the toner falling path is a conveying path from a toner falling port provided at a downstream side of a toner conveying direction of the screw to the waste toner accommodating unit disposed below the toner falling port.

4. The image forming apparatus of claim 3, wherein the toner falling port is provided at a position away from a rotary shaft core of the screw in a direction parallel with the horizontal direction and orthogonal to the rotary shaft core of the screw.

5. The image forming apparatus of claim 1, further comprising:

a full detection sensor that detects a full state of the waste toner in the waste toner accommodating unit, wherein a movable range of the movement member is set to a position above a detection position by the full detection sensor.

* * * * *